US011959281B2

(12) United States Patent
Boss et al.

(10) Patent No.: US 11,959,281 B2
(45) **Date of Patent: *Apr. 16, 2024**

(54) ROOFING SYSTEM AND ASSOCIATED ROOFING SHINGLE

(71) Applicant: BMIC LLC, Dallas, TX (US)

(72) Inventors: Daniel E. Boss, Morris Township, NJ (US); Ming-Liang Shiao, Basking Ridge, NJ (US); James Svec, Kearny, NJ (US); Chris Searcy, Tuscaloosa, AL (US); Nicholas Thurston, Tuscaloosa, AL (US)

(73) Assignee: BMIC LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/065,304

(22) Filed: Dec. 13, 2022

(65) Prior Publication Data

US 2023/0110284 A1 Apr. 13, 2023

Related U.S. Application Data

(63) Continuation of application No. 17/736,223, filed on May 4, 2022, which is a continuation of application (Continued)

(51) Int. Cl.

| | |
|---|---|
| ***E04D 1/36*** | (2006.01) |
| ***E04D 1/20*** | (2006.01) |
| *E04D 1/00* | (2006.01) |

(52) U.S. Cl.

CPC ..... *E04D 1/365* (2013.01); *E04D 1/20* (2013.01); *E04D 2001/005* (2013.01)

(58) Field of Classification Search

CPC ..... E04D 2001/005; E04D 1/365; E04D 1/26; E04D 2001/3473; E04D 2001/3491;

(Continued)

(56) References Cited

U.S. PATENT DOCUMENTS

RE16,621 E * 5/1927 Busha ..... E04D 1/26 52/555

RE16,832 E * 12/1927 O'Dell ..... E04D 1/34 52/545

(Continued)

FOREIGN PATENT DOCUMENTS

EP 3115524 A1 1/2017

OTHER PUBLICATIONS

GAF Timberline; Lifetime High Definition Shingles brochure; 2011, 13 pgs.

(Continued)

*Primary Examiner* — Brian E Glessner

*Assistant Examiner* — Adam G Barlow

(74) *Attorney, Agent, or Firm* — GREENBERG TRAURIG, LLP

(57) ABSTRACT

Roofing shingles are disclosed that are capable of self-adhering to a roof deck or underlayment and/or other roofing shingles and that require few or no mechanical fasteners to remain attached to the roof. By appropriate positioning of sealant lines on the shingle, direct adhesion between the shingle and the roof deck or underlayment and/or other roofing shingles can be achieved. If the shingle is laminated, the layers may be mechanically attached with indentations in the common bond area. The nail zone of the shingle may be visually indicated with fines and/or one or more paint lines. A roofing system comprising a plurality of courses of the shingles is also disclosed.

30 Claims, 11 Drawing Sheets

Related U.S. Application Data

No. 16/533,032, filed on Aug. 6, 2019, now Pat. No. 11,352,792.

(60) Provisional application No. 62/783,960, filed on Dec. 21, 2018, provisional application No. 62/714,827, filed on Aug. 6, 2018.

(58) Field of Classification Search
CPC .... E04D 2001/3435; E04D 2001/3447; E04D 2001/3455
See application file for complete search history.

(56) References Cited

U.S. PATENT DOCUMENTS 2,129,833 A * 9/1938 Fradette ..... E04D 1/365 52/24
2,161,440 A 6/1939 Venrick
3,138,897 A 6/1964 McCorkle
3,190,040 A 6/1965 Theobald
3,252,257 A * 5/1966 Price ..... E04D 1/26 52/518
4,738,884 A * 4/1988 Algrim ..... E04D 1/26 524/68
H788 H * 6/1990 Schneider, Jr. ..... B32B 7/12 216/48
5,000,826 A * 3/1991 Kitano ..... C25D 1/00 205/196
5,394,672 A 3/1995 Seem
5,822,943 A 10/1998 Frankoski et al.
5,950,387 A * 9/1999 Stahl ..... E04D 1/29 52/748.1
D417,513 S 12/1999 Blanpied
6,471,812 B1 10/2002 Thompson et al.
6,516,572 B1 2/2003 Nowacek et al.
6,804,919 B2 10/2004 Railkar
6,813,866 B2 11/2004 Naipawer, III
6,851,240 B2 2/2005 Peng et al.
6,936,239 B2 8/2005 Kiik et al.
6,968,662 B2 * 11/2005 Rodrigues ..... E04D 1/26 52/746.1
7,082,724 B2 8/2006 Railkar et al.
7,172,678 B2 2/2007 Canfield et al.
7,219,476 B2 5/2007 Akins et al.
7,272,915 B2 9/2007 Peng
D554,275 S 10/2007 Sieling et al.
7,320,767 B2 1/2008 Edge et al.
7,442,658 B2 10/2008 Rodrigues et al.
7,448,177 B2 11/2008 McClintick
7,454,873 B2 11/2008 McClintick
7,582,155 B2 9/2009 Mehta et al.
D611,620 S 3/2010 Kalkanoglu et al.
7,805,905 B2 10/2010 Rodrigues et al.
7,833,371 B2 11/2010 Binkley et al.
7,836,654 B2 11/2010 Belt et al.
7,851,051 B2 12/2010 Dejarnette et al.
7,861,631 B2 1/2011 Freshwater et al.
7,900,266 B1 3/2011 Longcor, IV
7,928,023 B2 4/2011 Canfield et al.
8,006,457 B2 * 8/2011 Binkley ..... E04D 1/26 52/557
8,033,072 B2 10/2011 McClintick
8,127,514 B2 3/2012 Binkley et al.
8,156,704 B2 4/2012 Belt et al.
8,181,413 B2 5/2012 Belt et al.
8,226,790 B2 7/2012 Rodrigues et al.
D665,103 S 8/2012 Rodrigues et al.
D665,104 S 8/2012 Rodrigues et al.
8,240,100 B2 8/2012 Kalkanoglu et al.
8,240,102 B2 8/2012 Belt et al.
D666,744 S 9/2012 Rodrigues et al.
D666,745 S 9/2012 Rodrigues et al.
D666,746 S 9/2012 Rodrigues et al.
D666,747 S 9/2012 Rodrigues et al.
8,297,020 B1 * 10/2012 Swanson ..... E04D 1/26 52/412
D670,407 S 11/2012 Leitch
D670,408 S 11/2012 Leitch
D670,409 S 11/2012 Leitch
D670,825 S 11/2012 Leitch
D670,826 S 11/2012 Leitch
D670,827 S 11/2012 Leitch
8,302,358 B2 11/2012 Kalkanoglu
8,316,608 B2 11/2012 Binkley et al.
8,381,489 B2 2/2013 Freshwater et al.
8,389,103 B2 3/2013 Kiik et al.
8,397,460 B2 3/2013 Rodrigues et al.
8,535,786 B2 * 9/2013 Schroer ..... E04D 5/148 52/409
8,607,521 B2 12/2013 Belt et al.
8,623,164 B2 1/2014 Belt et al.
8,752,351 B2 6/2014 Belt et al.
8,763,339 B2 7/2014 Bryson et al.
8,813,453 B2 8/2014 Kalkanoglu et al.
8,863,388 B2 10/2014 Aschoff et al.
8,978,332 B2 3/2015 Leitch
8,984,835 B2 * 3/2015 Kalkanoglu ..... B32B 38/10 52/557
8,991,130 B2 3/2015 Belt et al.
9,010,058 B2 4/2015 Dejarnette et al.
9,021,760 B2 5/2015 Kiik et al.
9,057,194 B2 6/2015 Jenkins et al.
9,121,178 B2 9/2015 Belt et al.
9,140,012 B1 9/2015 Leitch et al.
9,157,236 B2 * 10/2015 Jenkins ..... E04D 1/26
9,187,903 B1 11/2015 Buzza
9,212,487 B2 12/2015 Kiik et al.
D747,007 S 1/2016 Leitch
D747,501 S 1/2016 Leitch
D749,240 S 2/2016 Rodrigues et al.
D750,810 S 3/2016 Buzza
9,279,255 B2 3/2016 Bryson et al.
9,290,945 B2 3/2016 Beerer et al.
9,340,371 B2 5/2016 Mishler
D760,924 S 7/2016 Rodrigues et al.
D760,925 S 7/2016 Rodrigues et al.
D761,445 S 7/2016 Rodrigues et al.
D761,446 S 7/2016 Rodrigues et al.
D761,447 S 7/2016 Anderson et al.
9,399,870 B2 7/2016 Leitch et al.
9,399,871 B2 7/2016 Leitch et al.
D762,879 S 8/2016 Leitch
D762,880 S 8/2016 Leitch
D762,881 S 8/2016 Leitch
D763,468 S 8/2016 Leitch et al.
D763,470 S 8/2016 Leitch
D763,471 S 8/2016 Leitch
D764,076 S 8/2016 Leitch
D764,687 S 8/2016 Anderson et al.
D765,271 S 8/2016 Anderson et al.
D765,273 S 8/2016 Leitch et al.
D765,274 S 8/2016 Leitch et al.
9,404,260 B2 8/2016 Leitch
9,410,323 B1 8/2016 Leitch
9,416,539 B2 8/2016 Duque et al.
D765,885 S 9/2016 Leitch et al.
D765,886 S 9/2016 Leitch et al.
D765,887 S 9/2016 Leitch et al.
D765,888 S 9/2016 Leitch et al.
D766,466 S 9/2016 Leitch
D766,467 S 9/2016 Leitch
D766,468 S 9/2016 Leitch
D766,469 S 9/2016 Leitch et al.
D767,172 S 9/2016 Leitch
D767,272 S 9/2016 Gibson
D769,472 S 10/2016 Leitch
D769,473 S 10/2016 Rodrigues et al.
9,458,633 B2 * 10/2016 McGraw ..... B32B 27/32
9,464,439 B2 10/2016 Buzza
D774,215 S 12/2016 Duque et al.
D774,664 S 12/2016 Rodrigues et al.
9,523,202 B2 12/2016 Anderson et al.
D776,303 S 1/2017 Duque et al.

(56) References Cited

U.S. PATENT DOCUMENTS

| | | | | |
|---|---|---|---|---|
| 9,540,821 | B2 * | 1/2017 | Houchin | B32B 3/266 |
| 9,605,434 | B2 | 3/2017 | Belt et al. | |
| 9,624,670 | B2 | 4/2017 | Belt et al. | |
| 9,657,478 | B2 | 5/2017 | Belt et al. | |
| D793,584 | S | 8/2017 | Leitch | |
| 9,739,062 | B2 | 8/2017 | Leitch | |
| 9,752,324 | B2 | 9/2017 | Leitch | |
| 9,758,970 | B2 | 9/2017 | Grubka et al. | |
| D799,271 | S | 10/2017 | Pogue et al. | |
| D804,687 | S | 12/2017 | Duque et al. | |
| D805,221 | S | 12/2017 | Leitch | |
| 9,845,602 | B2 | 12/2017 | Kiik et al. | |
| 9,856,649 | B1 | 1/2018 | Selway | |
| 9,890,540 | B2 | 2/2018 | Weitzer | |
| 10,009,929 | B1 | 6/2018 | Zhou et al. | |
| D825,081 | S | 8/2018 | Rodrigues et al. | |
| D827,158 | S | 8/2018 | Duque et al. | |
| D827,159 | S | 8/2018 | Anderson et al. | |
| 10,060,132 | B2 | 8/2018 | Beerer et al. | |
| D827,864 | S | 9/2018 | Rodrigues et al. | |
| D827,865 | S | 9/2018 | Rodrigues et al. | |
| D827,866 | S | 9/2018 | Rodrigues et al. | |
| D827,867 | S | 9/2018 | Rodrigues et al. | |
| D827,868 | S | 9/2018 | Rodrigues et al. | |
| D829,935 | S | 10/2018 | Duque et al. | |
| D831,233 | S | 10/2018 | Anderson et al. | |
| D834,220 | S | 11/2018 | Duque et al. | |
| 10,180,001 | B2 | 1/2019 | Leitch | |
| 10,189,656 | B2 | 1/2019 | Belt et al. | |
| 10,195,640 | B2 | 2/2019 | Svec | |
| 10,196,821 | B2 | 2/2019 | Anderson et al. | |
| 10,308,448 | B2 | 6/2019 | Belt et al. | |
| 10,315,863 | B2 | 6/2019 | Belt et al. | |
| 10,322,889 | B2 | 6/2019 | Belt et al. | |
| 10,358,824 | B2 * | 7/2019 | Aschenbeck | E04D 1/36 |
| D856,538 | S | 8/2019 | Duque et al. | |
| D856,539 | S | 8/2019 | Duque et al. | |
| D857,931 | S | 8/2019 | Leitch | |
| D857,932 | S | 8/2019 | Leitch | |
| 10,415,247 | B2 | 9/2019 | Kilk et al. | |
| 10,428,525 | B2 | 10/2019 | Belt et al. | |
| 10,829,937 | B2 * | 11/2020 | Whitridge, Jr. | E04D 1/2918 |
| 10,995,495 | B2 | 5/2021 | Kiik et al. | |
| 11,002,015 | B2 | 5/2021 | Kiik et al. | |
| D943,642 | S | 2/2022 | Svec et al. | |
| 11,352,792 | B2 | 6/2022 | Boss et al. | |
| 11,377,731 | B2 | 7/2022 | Chikaishi et al. | |
| D973,583 | S | 12/2022 | Horikoshi et al. | |
| 2001/0055680 | A1 | 12/2001 | Kiik et al. | |
| 2003/0124292 | A1 | 7/2003 | Unterreiter | |
| 2004/0083674 | A1 | 5/2004 | Kalkanoglu et al. | |
| 2004/0123932 | A1 * | 7/2004 | Sanger | E04D 1/29 156/331.7 |
| 2004/0258883 | A1 | 12/2004 | Weaver | |
| 2005/0178428 | A1 | 8/2005 | Laaly et al. | |
| 2006/0269713 | A1 | 11/2006 | Zuege et al. | |
| 2008/0134612 | A1 | 6/2008 | Koschitzky | |
| 2009/0139175 | A1 * | 6/2009 | Todd | E04D 1/26 52/557 |
| 2009/0220720 | A1 | 9/2009 | Mohseen et al. | |
| 2010/0170169 | A1 | 7/2010 | Railkar et al. | |
| 2010/0173110 | A1 | 7/2010 | Wiercinski et al. | |
| 2011/0041446 | A1 | 2/2011 | Stephens et al. | |
| 2011/0086214 | A1 | 4/2011 | Rockwell | |
| 2012/0047838 | A1 * | 3/2012 | Kalkanoglu | E04D 1/34 156/60 |
| 2013/0025225 | A1 * | 1/2013 | Vermilion | E04D 1/26 52/518 |
| 2013/0068279 | A1 | 3/2013 | Buller et al. | |
| 2014/0147611 | A1 | 5/2014 | Ackerman, Jr. | |
| 2014/0283468 | A1 | 9/2014 | Weitzer | |
| 2015/0089895 | A1 * | 4/2015 | Leitch | E04D 1/26 52/518 |
| 2015/0176282 | A1 | 6/2015 | Baker | |
| 2016/0175923 | A1 * | 6/2016 | Liu | B22C 9/10 164/271 |
| 2016/0369509 | A1 | 12/2016 | Leitch et al. | |
| 2017/0314271 | A1 * | 11/2017 | Sutton | E04D 1/26 |
| 2017/0321423 | A1 * | 11/2017 | Aschenbeck | E04D 1/29 |
| 2018/0038108 | A1 * | 2/2018 | Aschenbeck | E04D 1/29 |
| 2018/0363302 | A1 | 12/2018 | Beerer et al. | |
| 2019/0256304 | A1 | 8/2019 | Belt et al. | |
| 2020/0040582 | A1 * | 2/2020 | Boss | E04D 1/20 |
| 2021/0108416 | A1 | 4/2021 | Aschenbeck et al. | |
| 2021/0317661 | A1 * | 10/2021 | Svec | E04D 1/365 |

OTHER PUBLICATIONS

Houston Restoration Services: Experienced Roofers Houston TX—Houston Roofing I "Roofing That Beats The Weather" I http://www.qualityroofertx.com/houston-roofing/roofing-thal-beats-lhe-weather.hlml, downloaded Mar. 16, 2020.

Trudefinition™ Duration® shingles with Surenail® technology I https:/lwww2.owenscorning.com/lilerature/pdfs/10013980.pdf.

"Installation instructions east asphalt shingles" I https://bpcan.com/wp-conlenl/uploads/2017/05/d-6013bpmode-de-pose-bardeauxeneasl.pdf, downloaded Mar. 18, 2020.

RegencyTM CRC Roofing Excellence I Regency Brochure I hllps://www.weblrack-cgs.ca/produclfiles/12824/CRC-Regency-Brochure.pdf.

Landmark™ Series and Landmark™ TL; CertainTeed Website; https://www.certainteed.com/residential-roofing/products/landmark-tl, downloaded Mar. 19, 2020.

What Makes the Windsor® a Designer Shingle! Malarkey Roofing Products I http://malarkeyroofing.com/blog/delail/whal-makes-the-windsor-a-designer-shingle, downloaded Mar. 18, 2020.

* cited by examiner

ROOFING SYSTEM AND ASSOCIATED ROOFING SHINGLE

CROSS REFERENCE TO RELATED APPLICATIONS

This application is a continuation of U.S. patent application Ser. No. 17/736,223, filed May 4, 2022, which is a continuation of U.S. patent application Ser. No. 16/553,032, filed Aug. 6, 2019, which claims priority to U.S. provisional application 62/783,960, filed Dec. 21, 2018, and U.S. provisional application 62/714,827, filed Aug. 6, 2018, the disclosures of each of which are incorporated herein by reference in their entireties.

FIELD OF THE INVENTION

This invention relates to roofing shingles, in particular to roofing shingles that are capable of self-adhering to a roof deck or underlayment and/or other roofing shingles and that require few or no mechanical fasteners to remain attached to the roof. By appropriate positioning of sealant lines on the shingle, direct adhesion between the shingle and the roof deck or underlayment and/or other roofing shingles can be achieved. The invention also relates to a roofing system that utilizes the shingles.

BACKGROUND OF THE INVENTION

Roofing shingles are typically attached to a roof deck with mechanical fasteners such as nails or staples. Mechanical fasteners prevent wind uplift of the shingles, reduce the risk of shingles sliding from the roof (for example, on a high pitch roof or under a load of snow) and improve the stability of the installed shingles so that they may be safely walked upon by roofers.

Mechanical fasteners, however, physically penetrate the shingles and the roof deck and therefore act as potential leak points for water. Moreover, as a roof ages the fasteners may corrode, increasing the risk of water entry and loss of shingle anchoring. The need for mechanical fasteners also increases installation time and costs because many nails are required to secure all of the shingles to a given roof. In addition, the application of mechanical fasteners presents potential safety hazards for roofers due to the presence of nail guns and hoses. For example, a roofer may trip on the gun or hose, or a nail may inadvertently perforate a hose that is being used on the roof.

Furthermore, some shingle designs require that the fasteners are driven through specific locations of the shingle area. For example, in the case of laminated shingles having a backer strip adhered to an upper layer, fasteners must be placed in the common bond area where the two layers are attached to one another across the length of the shingle, which is known as the nail zone. Typically, the nail zone is relatively narrow, thus requiring the roofer to pay careful attention to the positioning of the fasteners. Installation of laminated shingles could thus be rendered easier and faster if the roofer had more flexibility in where to position the fasteners; if fewer fasteners were needed; or if fasteners were unnecessary.

Traditional roofing shingles include a sealant line at or near the front edge on the back surface to provide adhesion between shingles in adjacent courses so as to reduce wind uplift. Without other fastening means, however, such sealant does not provide sufficient adhesion to retain the shingles on a roof.

U.S. Pat. No. 7,219,476 discloses a shingle roofing system that does not require nails. The roofing system includes a hook and loop foundation layer. A disadvantage of this approach is that material costs are relatively high due to the need for an additional specialty foundation layer and hook-loop system. The requirement for the application of tensile forces to engage the hook-loop system during installation is a further disadvantage. Moreover, the total installation time of such systems, including the installation of the underlayment, foundation layer, and the individual shingles, may be greater than for conventional systems. Also, hook and loop systems can present challenges for removal during reroofing because each individual shingle has to be removed manually.

U.S. Pat. No. 4,738,884 and U.S. Patent App. Pub. No. 2017/0314271 disclose shingles having multiple sealant lines. These shingles, however, require mechanical fasteners in order to achieve adequate attachment to the roof deck.

U.S. Pat. No. 8,297,020 discloses shingles having multiple sealant lines and a trap lock mechanism to secure the shingles together. A disadvantage of this approach is that it increases the amount of material needed to cover the roof area, resulting in less efficient material utilization. Another disadvantage is that installing such a system in complex roof structures such as dormer, valley, or roof penetrations can be challenging. Also, installing shingles from the ridge line downward can present a safety concern since the installers may not be able to clearly see conditions behind themselves when stepping downward.

There exists an on-going need to reduce or eliminate the use of mechanical fasteners for attaching shingles to the roof deck, without compromising wind performance or roof stability.

SUMMARY OF THE INVENTION

In an embodiment, the invention features a roofing shingle having a front surface, a back surface, a top edge, a lower edge, a length, a width and a total of 2 or 3 sealant lines, wherein between 0 and 3 sealant lines are disposed on the front surface and between 0 and 3 sealant lines are disposed on the back surface, and wherein each sealant line extends substantially across the length of the roofing shingle.

In an embodiment, the roofing shingle has a front sealant line, a first back sealant line and a second back sealant line.

In an embodiment, the front sealant line is positioned from about 46% to about 54% of the width of the roofing shingle from the top edge.

In an embodiment, the first back sealant line is positioned from about 8% to about 25% of the width of the roofing shingle from the top edge.

In an embodiment, the second back sealant line is positioned from about 42% to about 58% of the width of the roofing shingle from the top edge.

In an embodiment, the roofing shingle is a single-layer roofing shingle.

In an embodiment, the lower edge is cut to form tabs and openings.

In an embodiment, the invention features a laminated roofing shingle having an upper layer, a backer strip, a top edge, a lower edge, a length, a width and a total of 2 or 3 sealant lines, wherein the upper layer has a front surface, a back surface, a top edge, a lower edge, a length and a width, wherein the backer strip has a front surface, a back surface, a top edge, a lower edge, a length and a width, wherein between 0 and 3 sealant lines are disposed on the upper layer and between 0 and 3 sealant lines are disposed on the backer strip, and wherein each sealant line extends substantially across the length of the roofing shingle.

In an embodiment, the laminated roofing shingle has a first sealant line on the back surface of the upper layer, a second sealant line on the back surface of the backer strip and a third sealant line on the back surface of the backer strip.

In an embodiment, the first sealant line on the back surface of the upper layer is positioned from about 4% to about 19% of the width of the roofing shingle from the top edge.

In an embodiment, the second sealant line on the back surface of the backer strip is positioned from about 47% to about 62% of the width of the roofing shingle from the top edge.

In an embodiment, the third sealant line on the back surface of the backer strip is positioned from about 91% to about 98% of the width of the roofing shingle from the top edge.

In an embodiment, the laminated roofing shingle has a first sealant line on the back surface of the upper layer and a second sealant line on the back surface of the backer strip.

In an embodiment, the first sealant line on the back surface of the upper layer is positioned from about 8% to about 9% of the width of the roofing shingle from the top edge of the backer strip.

In an embodiment, the second sealant line on the back surface of the backer strip is positioned at approximately the lower edge of the roofing shingle.

In an embodiment, the first sealant line on the back surface of the upper layer is thicker than the thickness of the backer strip.

In an embodiment, one or more mechanical attachments affix the upper layer to the backer strip.

In an embodiment, at least one of the one or more mechanical attachments are indentations or stitches.

In an embodiment, at least one of the indentations has a hemisphere, half moon, rounded rectangle, rounded pin, rivet or bar geometry.

In an embodiment, the indentations have a hemisphere geometry.

In an embodiment, an adhesive material is positioned between the back surface of the upper layer and the front surface of the backer strip.

In an embodiment, the width of the upper layer is equal to the width of the roofing shingle and the width of the backer strip is less than the width of the roofing shingle.

In an embodiment, the width of the backer strip is about 49% of the width of the roofing shingle.

In an embodiment, the lower edge of the backer strip is aligned with the lower edge of the roofing shingle.

In an embodiment, the lower edge of the front layer is cut to form tabs and openings.

In an embodiment, the tab height is less than the width of the backer strip.

In an embodiment, the invention features a roofing system comprising a roof deck and at least two roofing shingles in vertically adjacent courses, each of the roofing shingles having: a front surface, a back surface, a length, a width and a total of 2 or 3 sealant lines, wherein between 0 and 3 sealant lines are disposed on the front surface and between 0 and 3 sealant lines are disposed on the back surface of each roofing shingle, and wherein each sealant line extends substantially across the length of each roofing shingle.

In an embodiment, the sealant lines are positioned such that at least one sealant line per roofing shingle is in contact with the roof deck, an underlayment or other material that is positioned between the roof deck and the shingle.

In an embodiment, two sealant lines are disposed on the back surface of each roofing shingle, and one sealant line is disposed on the front surface of each roofing shingle.

In an embodiment, three sealant lines are disposed on the back surface of each roofing shingle.

In an embodiment, two sealant lines are disposed on the back surface of each roofing shingle.

In an embodiment, a sealant line on one shingle is approximately vertically aligned with a sealant line positioned on one other shingle.

In an embodiment, a sealant line on one shingle is approximately vertically aligned with sealant lines positioned on two other shingles.

In an embodiment, at least about 50% of the roofing shingles are not attached to the roof deck with fasteners.

In an embodiment, at least about 70% of the roofing shingles are not attached to the roof deck with fasteners.

In an embodiment, at least about 90% of the roofing shingles are not attached to the roof deck with fasteners.

In an embodiment, 2 or 3 fasteners per roofing shingle attach each roofing shingle to the roof deck.

In an embodiment, each fastener passes through 2 or 3 shingles.

In an embodiment, each fastener passes through 3 shingles.

In an embodiment, the fasteners are nails.

In an embodiment, a nail zone of each roofing shingle extends about 2 inches across the width of each roofing shingle.

In an embodiment, the nail zone of each roofing shingle extends across about 5% of the width of each roofing shingle.

In an embodiment, the nail zone of each roofing shingle is indicated with fines.

In an embodiment, the nail zone of each roofing shingle is indicated with one or more paint lines.

In an embodiment, the roofing system passes the ASTM D3161 test at 110 mph.

In an embodiment, the roofing system passes the ASTM D3161 test at 150 mph.

BRIEF DESCRIPTION OF THE FIGURES

For a more complete understanding of the present invention and the advantages thereof, reference is made to the following descriptions, taken in conjunction with the accompanying figures, in which.

DETAILED DESCRIPTION

One embodiment of this invention pertains to a roofing shingle having one or more sealant lines. Preferably, the shingle is capable of adhering to a roof deck underlayment, other intermediate material positioned between the shingle and the roof deck and/or other roofing shingles with few or no mechanical fasteners (such as nails or staples) while maintaining ASTM D3161 Class F (110 mph) wind performance.

Roofing shingles are typically installed on a roof in overlapping horizontal courses and are secured in place with mechanical fasteners. Traditional shingles include a lateral sealant line extending across the length of the shingle that causes adhesion between the lower edge of shingles in an upper course and the shingles in a lower course, thereby preventing wind uplift. In the shingles of the present invention, however, additional sealant lines are present that provide adhesion between the shingles and the roof deck, underlayment or other intermediate material positioned between the shingles and the roof deck, as well as enhancing the adhesion between shingles in adjacent courses.

The sealant lines of the present invention may be disposed on the front surface of the shingle, the back surface of the shingle or on both the front and back surfaces of the shingle. In an embodiment, there are between 0 and 3 sealant lines on the back surface of the shingle and between 0 and 3 sealant lines on the front surface of the shingle.

In a preferred embodiment, two sealant lines are disposed on the back surface of the shingle and one sealant line on the front surface. In another preferred embodiment, three sealant lines are disposed on the back surface of the shingle. In yet another preferred embodiment, two sealant lines are disposed on the back surface of the shingle.

In an embodiment, the shingle is a single-layer shingle. In another embodiment, the shingle is a multilayer shingle having two or more layers. The layers of the multilayer shingle may be attached to one another by any method known in the art. For example, they may be attached mechanically, with an adhesive, or by a combination of these methods. Preferably, the multilayer shingle layers are attached to one another as described in U.S. Pat. Nos. 7,833,371, 8,006,457, 8,127,514 and 8,316,608, the disclosures of which are incorporated by reference herein in their entireties.

Figure 13:
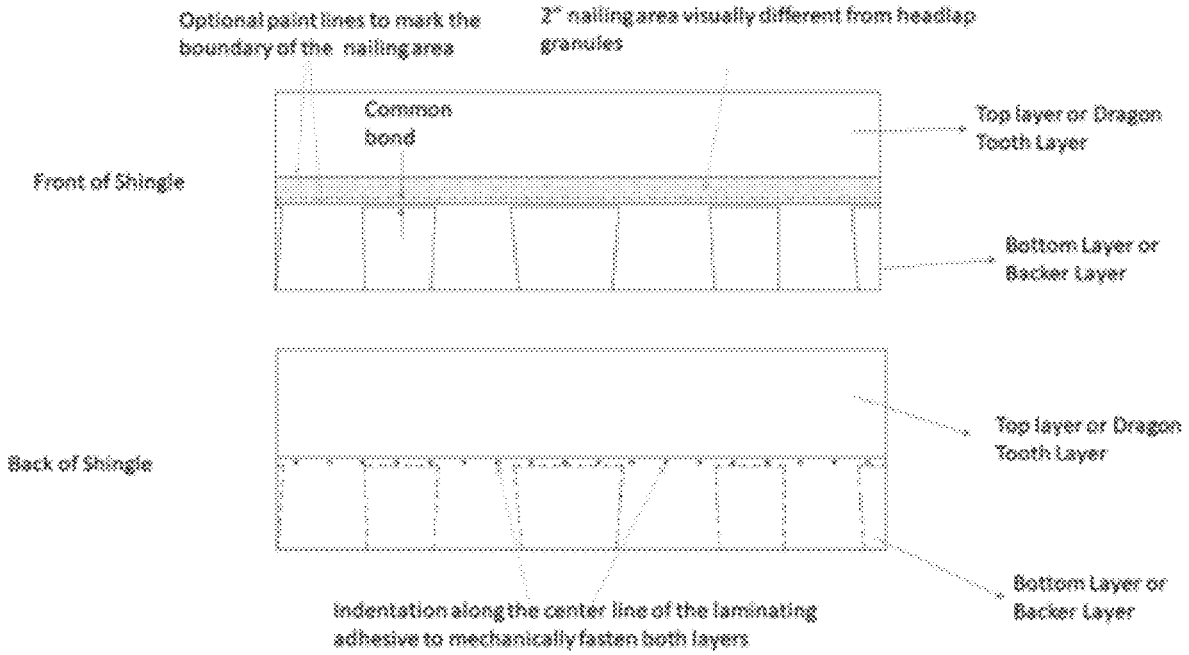
FIG. 13 is a front and back view of a two-layer laminated shingle having indentations punched between the layers, and a visually distinct nail zone that is also marked with paint lines.

It has been found that the use of mechanical indentations or stitches in combination with an adhesive reduces slippage of the shingle layers during hot weather, meaning that fewer or no nails need to be positioned in the common bond area to hold the layers of the shingle together. As a result, the nail zone can be wider, facilitating and speeding installation. In a preferred embodiment, the nail zone is about 2 inches wide. Preferably, the nail zone is visibly marked with a fines stripe and/or one or more paint lines, as shown in FIG. 13. The fine stripe may enhance nail pull through resistance.

Figure 14:
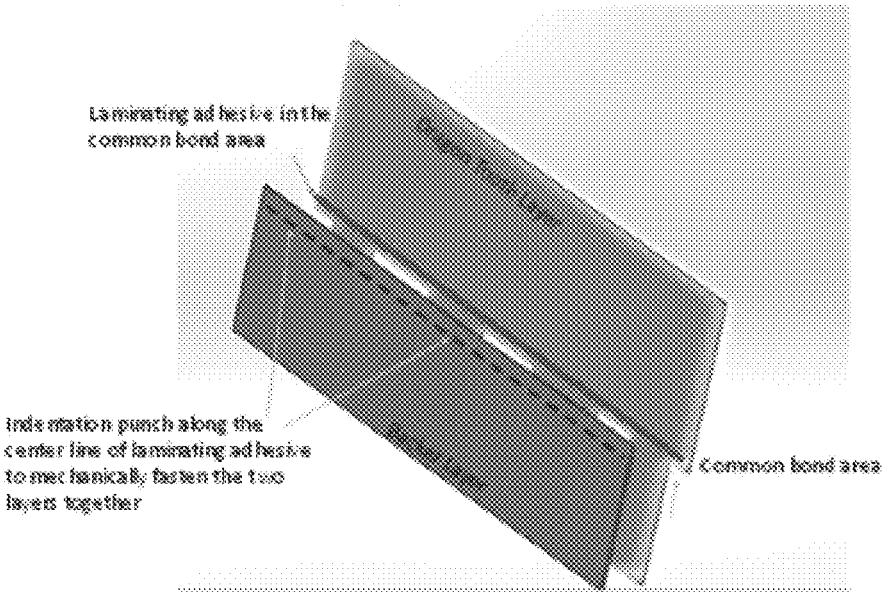
FIG. 14 is an exploded view of a two-layer laminated shingle having indentations punched between the layers.
Figure 15:
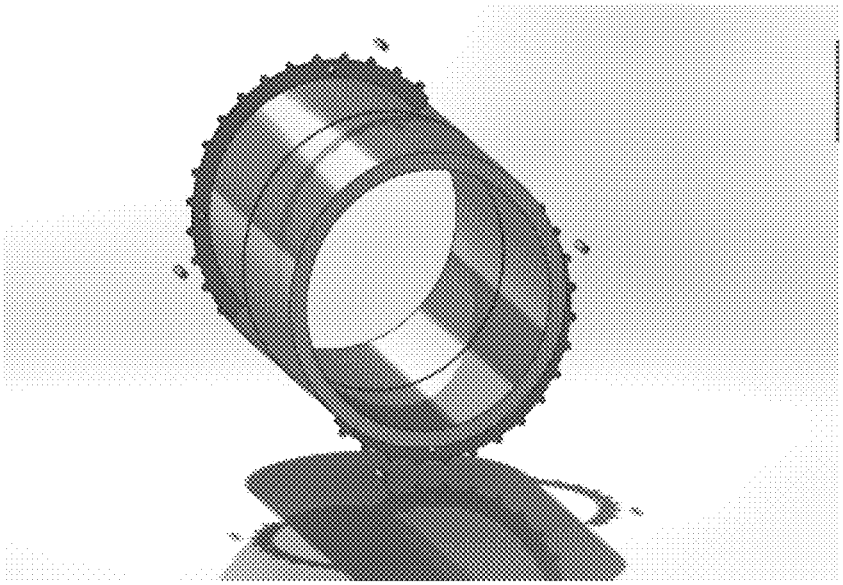
FIG. 15 shows an indentation punch wheel used to mechanically attach the layers of a laminated shingle.
Figure 16:
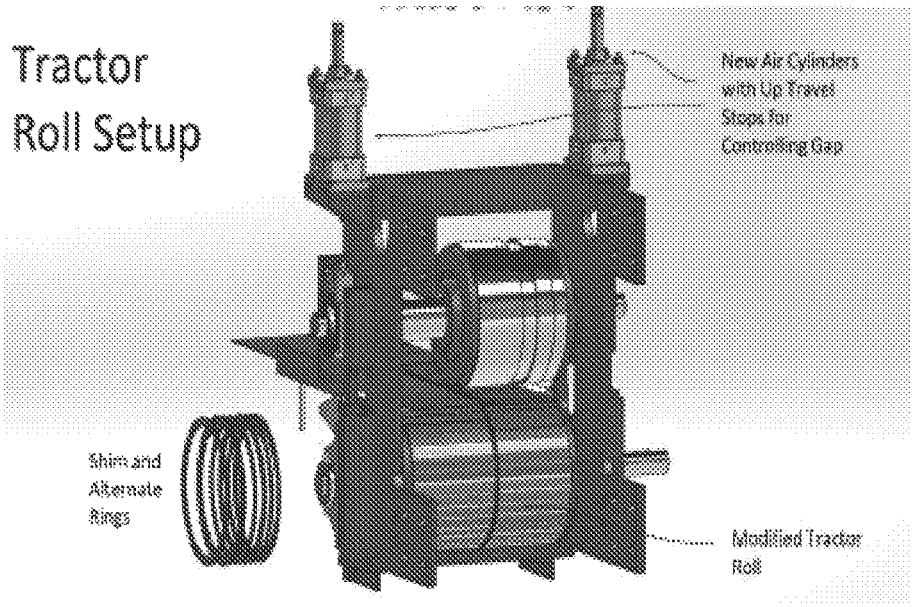
FIG. 16 shows an apparatus for forming indentation punches for attaching the layers of a laminated shingle.
Figure 17:
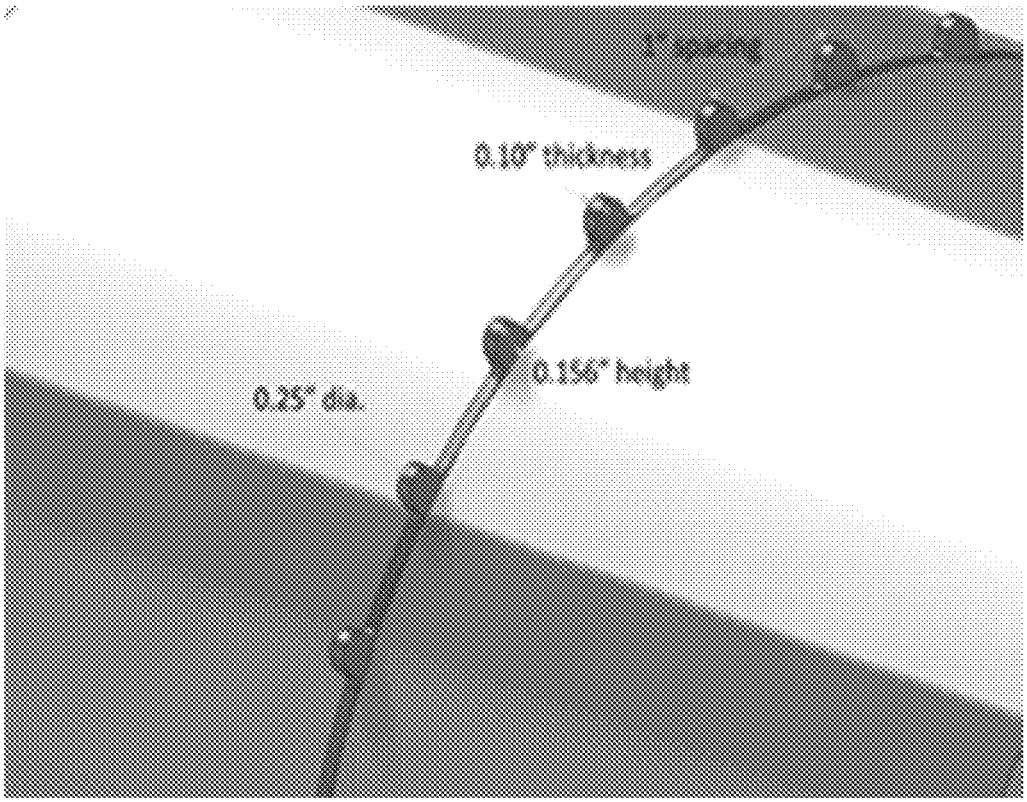
FIG. 17 is a view of an indentation punch wheel showing the geometry of the punches.

In a preferred embodiment, the mechanical attachment between the layers is formed by an indentation punch in which one layer of the shingle is partially pressed into the other layer. Preferably, the indentations are made on the back side of the laminated shingle such that the back layer is partially indented into the front layer, as shown in FIGS. 13 & 14. Preferably, the indentations are made in the area where laminating adhesive is applied in the common bond area, and is performed shortly after application of the laminating adhesive. Without wishing to be bound by a theory, it is thought that the indentation force allows the still flowable adhesive to penetrate more deeply between the layers. In a preferred embodiment, the indentations are created by a punch wheel, as shown in FIGS. 15-17.

In a preferred embodiment, the geometry of the indentations is a hemisphere (also referred to as a dome), half moon, rounded rectangle, rounded pin, rivet and/or bar. Preferably, the geometry of the indentations is a hemisphere.

In an embodiment, the punch depth of the indentations is between about 0.1 inches and about 0.2 inches; between about 0.11 inches and about 0.18 inches; or between about 0.12 inches and about 0.16 inches. In a preferred embodiment, the punch depth of the indentations is about 0.125 inches. In an embodiment, the punch depth of the indentations is less than about 90% of the thickness of the common bond area; less than about 65% of the thickness of the common bond area; or less than about 50% of the thickness of the common bond area.

In an embodiment, the punch length of the indentations is between about 0.05 inches and about 0.15 inches; or between about 0.1 inches and about 0.125 inches.

In an embodiment, the punch width of the indentations is between about 0.1 inches and about 1 inch; between about 0.1 inches and about 0.5 inches; or between about 0.2 inches and about 0.3 inches. In a preferred embodiment, the punch width of the indentations is about 0.25 inches.

In an embodiment, the punch radius of the rounded portion of the indentations is between about 0.05 inches and about 0.7 inches; between about 0.1 inches and about 0.5 inches; or between about 0.1 inches and about 0.2 inches. In a preferred embodiment, the punch radius of the rounded portion of the indentations of the indentations is about 0.125 inches.

In an embodiment, the punch spacing of the indentations is between about 0.1 inches and about 5 inches; between about 0.25 inches and about 2.5 inches; or between about 0.5 inches and about 2 inches. In a preferred embodiment, the punch spacing of the indentations is about 2 inches.

It has been found that by selection of an appropriate punch size, geometry and spacing of the indentations, cracking of the shingle during handling of the shingle bundle prior to installation is reduced.

In a preferred embodiment, the shingle is a single-layer shingle having two sealant lines on the back surface and one sealant line on the front surface of the shingle. In another preferred embodiment, the shingle is a two-layer shingle having three sealant lines on the back surface of the shingle. In yet another preferred embodiment, the shingle is a two-layer shingle having two sealant lines on the back surface of the shingle.

Preferably, the width of the sealant lines is between about 0.125 inches and about 0.625 inches. In a preferred embodiment, the width of the sealant lines is about 0.375 inches.

Preferably, the thickness of the sealant lines is between about 5 mils and about 200 mils. In a preferred embodiment, the thickness of the sealant lines is between about mils and about 70 mils. In another preferred embodiment, the thickness of the sealant lines is between about 80 mils and about 200 mils. In a particularly preferred embodiment, the thickness of the sealant lines is between about 15 mils and about 50 mils. In another particularly preferred embodiment, the thickness of the sealant lines is between about 100 mils and about 150 mils.

Figure 1:
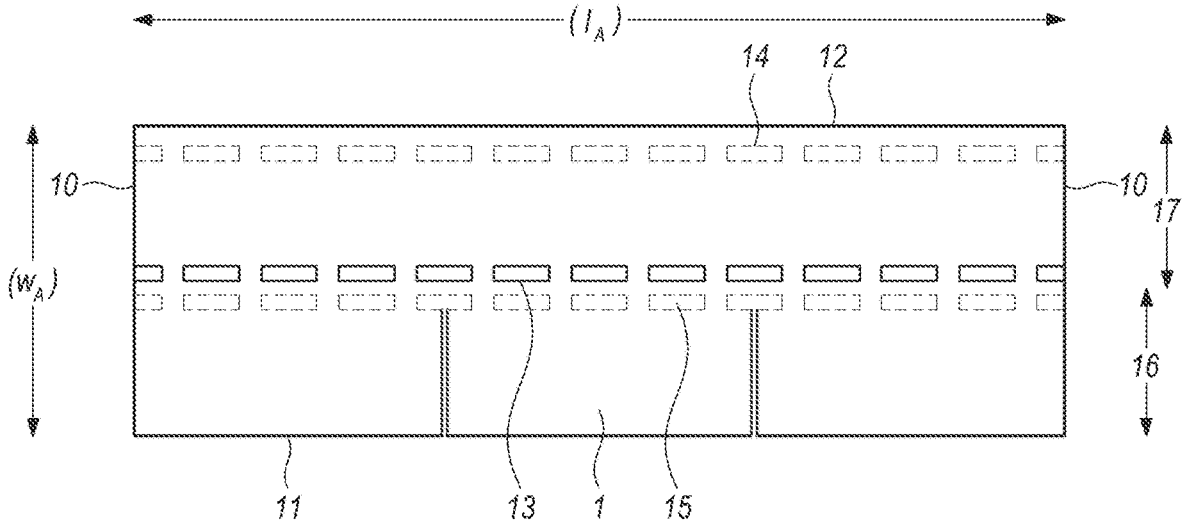
FIG. 1 is a front plan view of a single-layer shingle having a first sealant line on the front face of the shingle and two sealant lines on the back face of the shingle.
Figure 2:
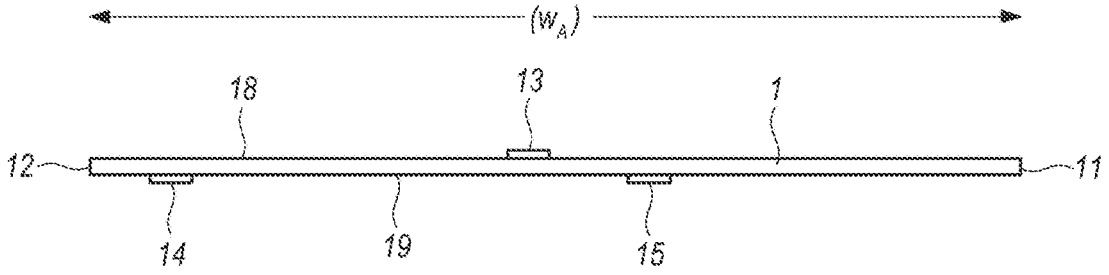
FIG. 2 is a side view of a single-layer shingle having a first sealant line on the front face of the shingle and two sealant lines on the back face of the shingle.

One embodiment of this invention is a single layer shingle 1, shown in FIGS. 1 and 2. FIG. 1 illustrates a front plan view of shingle 1 and FIG. 2 illustrates a side view. Shingle 1 has a width (wA), a length (IA). Preferably, the width (wA) of the shingle is about 12 inches and the length (IA) of the shingle is about 36 inches. The shingle 1 has side edges 10, a lower edge 11, a top edge 12, a buttlap 16, a headlap 17, a front surface 18 and a back surface 19. As illustrated in FIGS. 1 and 2, shingle 1 has a front sealant line 13, a first back sealant line 14 and a second back sealant line 15.

In an embodiment, the front sealant line 13 is disposed from 46% to about 54% of the width of the roofing shingle from the top edge 12 of the shingle. The first back sealant line 14 is disposed from about 8% to about 25% of the width of the roofing shingle from the top edge 12 of the shingle. The second back sealant line 15 is disposed from about 42% to about 58% of the width of the roofing shingle from the top edge 12 of the shingle.

In an embodiment, the front sealant line 13 is disposed from about 5.5 inches to about 6.5 inches from the top edge 12 of the shingle. The first back sealant line 14 is disposed from about 1 inch to about 3 inches from the top edge 12 of the shingle. The second back sealant line 15 is disposed from about 5 inches to about 7 inches from the top edge 12 of the shingle.

Preferably, the thickness of the sealant lines of shingle 1 is between about 5 mils and about 70 mils. In a preferred embodiment, the thickness of the sealant lines of shingle 1 is between about 15 mils and about 50 mils.

The first back sealant line 14 is thus disposed on the headlap portion 17 of the shingle on the back surface 19. Preferably, the first back sealant line 14 is positioned close to the top edge 12.

Figure 3:
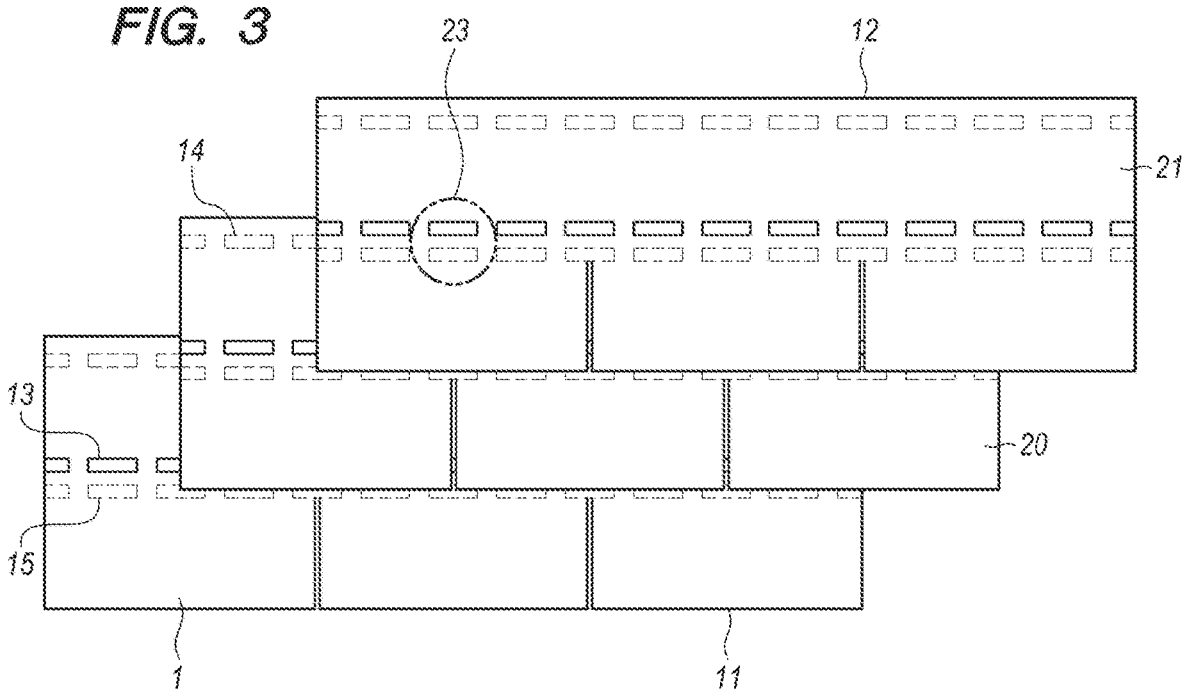
FIG. 3 is a front plan view of a roofing system of single-layer shingles having a first sealant line on the front face of the shingles and two sealant lines on the back face of the shingles.
Figure 4:
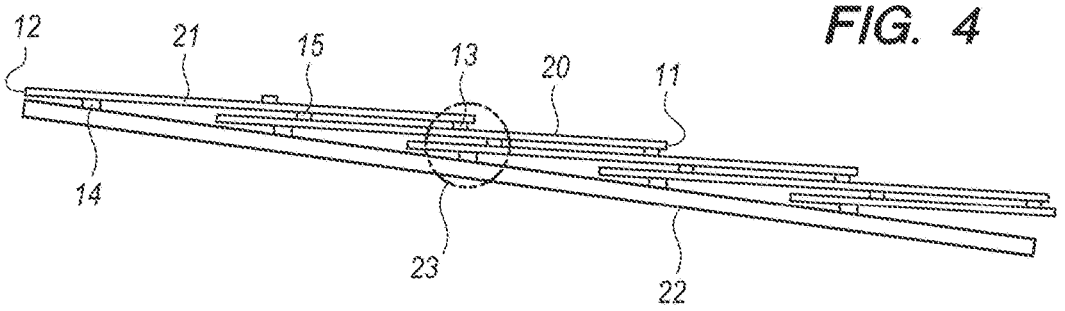
FIG. 4 is a side view of a roofing system of single-layer shingles having a first sealant line on the front face of the shingles and two sealant lines on the back face of the shingles.

As shown in FIGS. 3 and 4, when shingles are installed on a roof deck in a series of overlapping courses, the front sealant line 13 provides adhesion between the front surface 18 of a shingle in a lower course 20 and the lower edge 11 of the back surface 19 of a shingle in an upper course 21. The first back sealant line 14 provides adhesion between the shingle and the roof deck 22. The second back sealant line 15 provides adhesion between the back surface 19 of a shingle in an upper course 21 and the front surface 18 of a shingle in a lower course 20. As a result of the relative positioning of the sealant lines, when installed on a roof deck 22 the second back sealant line 15 of a shingle in an upper course 21 and the front sealant line 13 on the same upper course shingle approximately align with the first back sealant line 14 of a shingle in a lower course 20. This configuration provides a strong load path 23 of the shingles to the roof deck 22 and improves resistance to wind billowing.

Figure 5:
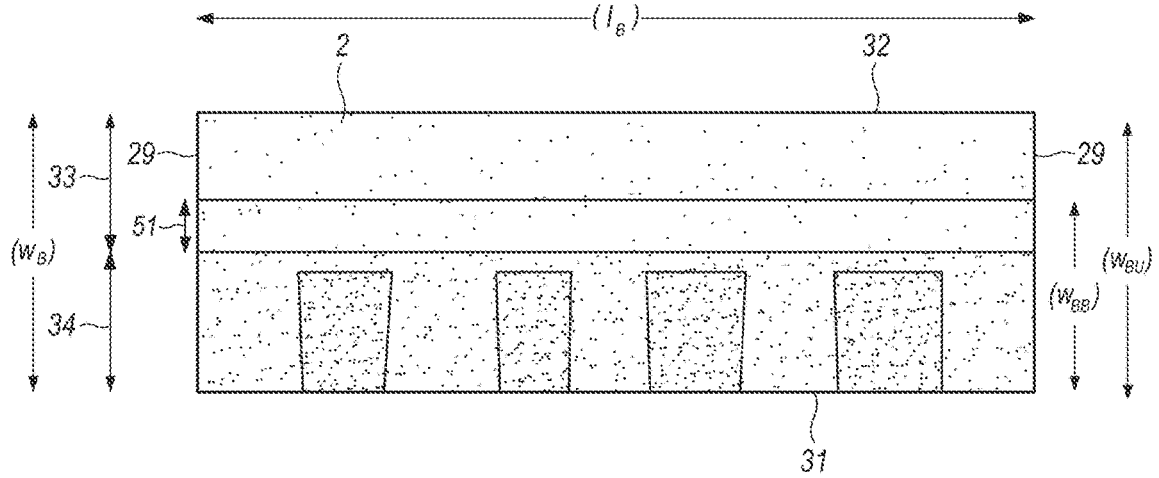
FIG. 5 is a front plan view of a two-layer shingle having three sealant lines on the back face of the shingle.
Figure 6:
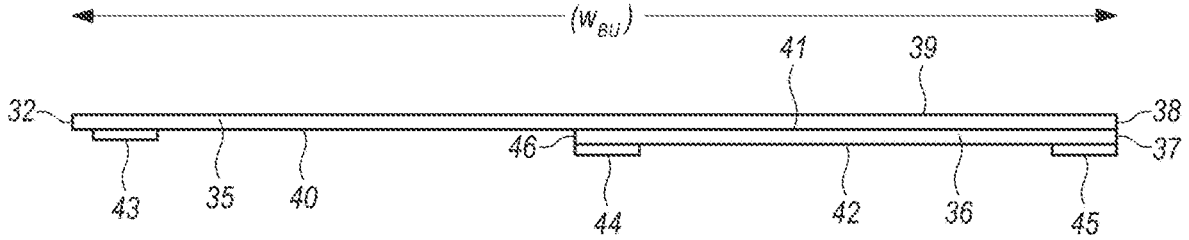
FIG. 6 is a side view of a two-layer shingle having three sealant lines on the back face of the shingle.

Another embodiment of this invention is a two-layer shingle 2, shown in FIGS. 5 and 6.

FIG. 5 illustrates a front plan view of shingle 2 and FIG. 6 illustrates a side view of shingle 2. Shingle 2 has a width (wB) and a length (IB). The shingle 2 has side edges 29, a lower edge 31, a top edge 32, a headlap 33, a buttlap 34, an upper layer 35 and a backer strip 36. The backer strip 36 is attached to the upper layer 35. The upper layer has a width (wBU) and the backer strip 36 has a width (wBB). In a preferred embodiment, the width of the upper layer (wBU) is equal to the width (WB) of the shingle and the width of the backer strip (wBB) is less than the width (wB) of the shingle. Preferably, the width (wB) of the shingle 2 is about 13.25 inches, the length (IB) of the shingle 2 is about 39.375 inches, the width of the upper layer (wBU) is about 13.25 inches and the width of the backer strip (wBB) is about 6.5 inches. In a preferred embodiment, the lower edge 37 of the backer strip 36 is aligned with the lower edge 38 of the upper layer 35. Hence, the upper layer 35 completely overlaps the backer strip 36. The upper layer 35 has a front surface 39 and a back surface 40. The backer strip 36 has a front surface 41 and a back surface 42.

As illustrated in side view FIG. 6, shingle 2 has a first sealant line 43 on the back surface 40 of the upper layer 35, a second sealant line 44 on the back surface 42 of the backer strip 36 and a third sealant line 45 on the back surface 42 of the backer strip 36.

In an embodiment, first sealant line 43 is disposed from about 4% to about 19% of the width of the roofing shingle from the top edge 32 of the shingle. Second sealant line 44 is disposed from about 47% to about 62% of the width of the roofing shingle from the top edge 32 of the shingle. Third sealant line 45 is disposed from about 91% to about 98% of the width of the roofing shingle from the top edge 32 of the shingle.

In an embodiment, first sealant line 43 is disposed from about 0.5 inches to about 2.5 inches from the top edge 32 of the shingle. Second sealant line 44 is disposed from about 6.25 inches to about 8.25 inches from the top edge 32 of the shingle. Third sealant line 45 is disposed from about 12 inches to about 13 inches from the top edge 32 of the shingle.

Preferably, the thickness of the sealant lines of shingle 2 is between about 5 mils and about 70 mils. In a preferred embodiment, the thickness of the sealant lines of shingle 2 is between about 15 mils and about 50 mils.

In a preferred embodiment, first sealant line 43 is positioned close to the top edge 32 of the shingle. Preferably, second sealant line 44 is positioned close to the top edge 46 of the backer strip 36. In another preferred embodiment, third sealant line 45 is positioned close to the lower edge 37 of the backer strip 36.

Figure 7:
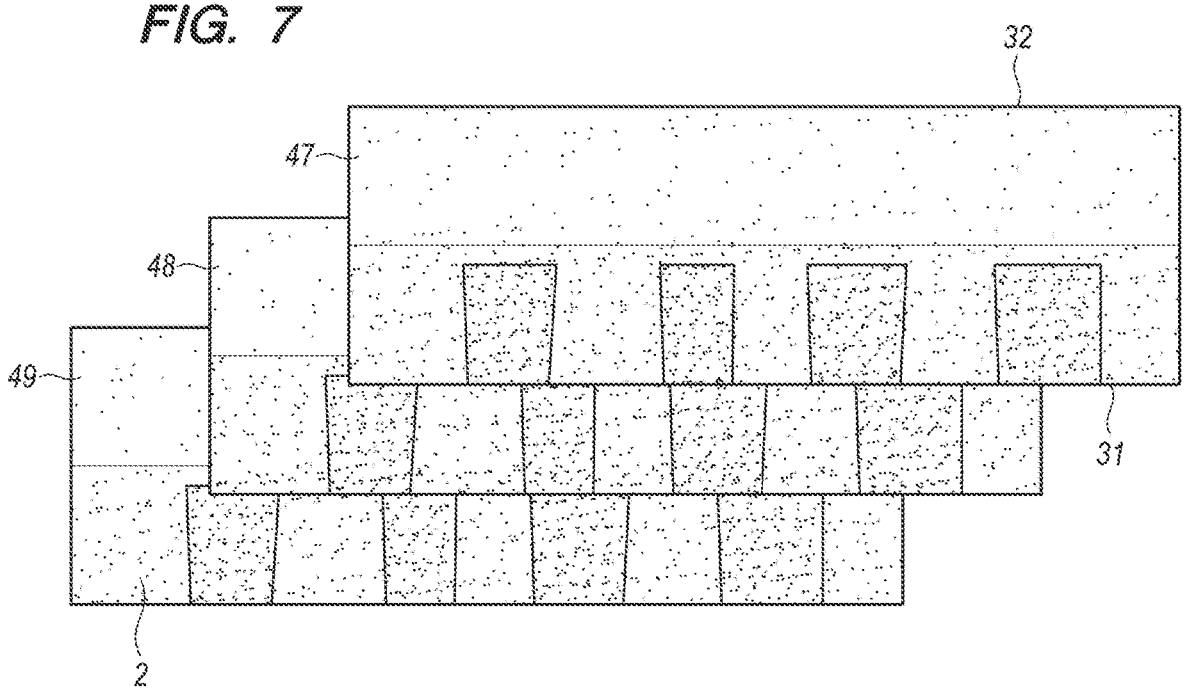
FIG. 7 is a front plan view of a roofing system of two-layer shingles having three sealant lines on the back face of the shingles.
Figure 8:
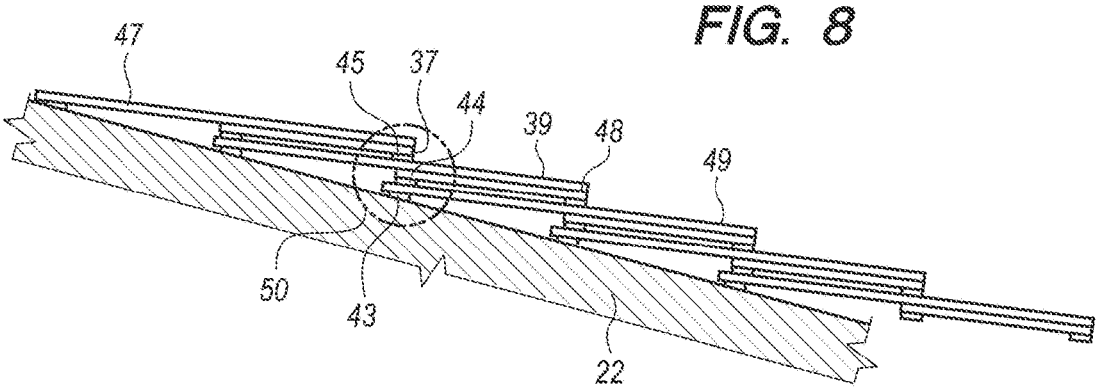
FIG. 8 is a side view of a roofing system of two-layer shingles having three sealant lines on the back face of the shingles.

As shown in FIGS. 7 and 8, when installed on a roof deck in a series of overlapping courses, first sealant line 43 provides adhesion between the back surface of the upper layer 35 of the shingle and the roof deck 22. Second sealant line 44 provides adhesion between the top edge 46 of the backer strip 36 of a shingle in an intermediate course 48 and the top edge 32 of a shingle in a lower course 49. Third sealant line 45 provides adhesion between the lower edge 37 of the backer 36 strip of a shingle in an upper course 47 and front surface 39 of the upper layer of a shingle in an intermediate course 48.

As a result of the relative positioning of the sealant lines, when installed on a roof deck 22 the third sealant line 45 of a shingle in an upper course 47 approximately aligns with the second sealant line 44 of a shingle in an intermediate course 48 and with first sealant line 43 on the of a shingle in a lower course 49. This configuration provides a strong load path 50 of the shingles to the roof deck 22 and improves resistance to wind billowing.

Figure 9:
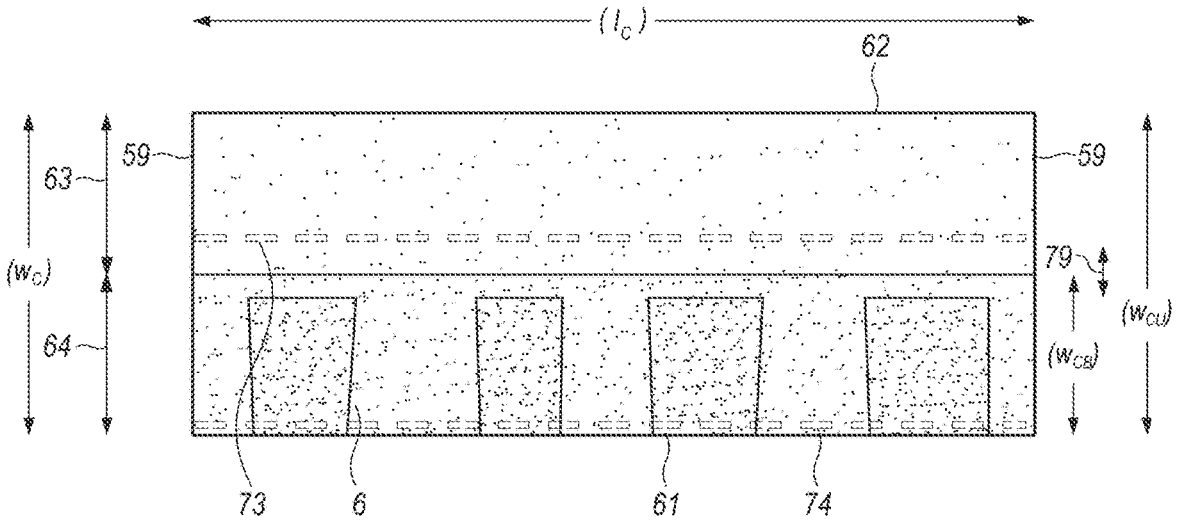
FIG. 9 is a front plan view of a two-layer shingle having two sealant lines on the back face of the shingle.
Figure 10:
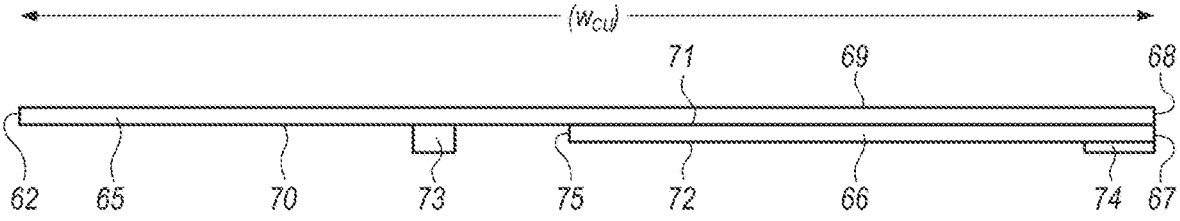
FIG. 10 is a side view of a two-layer shingle having two sealant lines on the back face of the shingle.

Another embodiment of this invention is a two-layer shingle 6, shown in FIGS. 9 and 10.

FIG. 9 illustrates a front plan view of shingle 6 and FIG. 10 illustrates a side view of shingle 6. Shingle 6 has a width (wC) and a length (IC). The shingle 6 has side edges 59, a lower edge 61, a top edge 62, a headlap 63, a buttlap 64, an upper layer 65 and a backer strip 66. The backer strip 66 is attached to the upper layer 65. The upper layer 65 has a width (wCU) and the backer strip 66 has a width (wCB). In a preferred embodiment, the width of the upper layer (wCU) is equal to the width (wC) of the shingle and the width of the backer strip (wCB) is less than the width (wC) of the shingle. Preferably, the width (wC) of the shingle 6 is about 13.25 inches, the length (IC) of the shingle 6 is about 39.375 inches, the width of the upper layer (wCU) is about 13.25 inches and the width of the backer strip (wCB) is about 6.5 inches. In a preferred embodiment, the lower edge 67 of the backer strip 66 is aligned with the lower edge 68 of the upper layer 65. Hence, the upper layer 65 completely overlaps the backer strip 66. The upper layer 65 has a front surface 69 and a back surface 70. The backer strip 66 has a front surface 71 and a back surface 72.

As illustrated in side view FIG. 10, shingle 6 has a first sealant line 73 on the back surface 70 of the upper layer 65 and a second sealant line 74 on the back surface 72 of the backer strip 66. The lower edge of first sealant line 73 is disposed from about 7.4625 inches to about 7.6875 inches from the top edge 62 of the shingle. Second sealant line 74 is disposed from about 12 inches to about 13 inches from the top edge 62 of the shingle.

In an embodiment, first sealant line 73 is positioned close to the top edge 75 of the backer strip 66 at a distance that is about 8% to about 9% of the width of the roofing shingle from the top edge 75 of the backer strip 66. Preferably, second sealant line 74 is positioned close to the lower edge 67 of the backer strip 66.

In an embodiment, first sealant line 73 is positioned close to the top edge 75 of the backer strip 66 at a distance that is about 1.0625 inches to about 1.1875 inches from the top edge 75 of the backer strip 66. Preferably, second sealant line 74 is positioned close to the lower edge 67 of the backer strip 66.

Preferably, the thickness of first sealant line 73 is between about 80 mils and about 200 mils. In a preferred embodiment, the thickness of first sealant line 73 is between about 100 mils and about 150 mils. Preferably, the thickness of second sealant line 74 is between about 5 mils and about 70 mils. In a preferred embodiment, the thickness of second sealant line 74 is between about 15 mils and about 50 mils.

Figure 11:
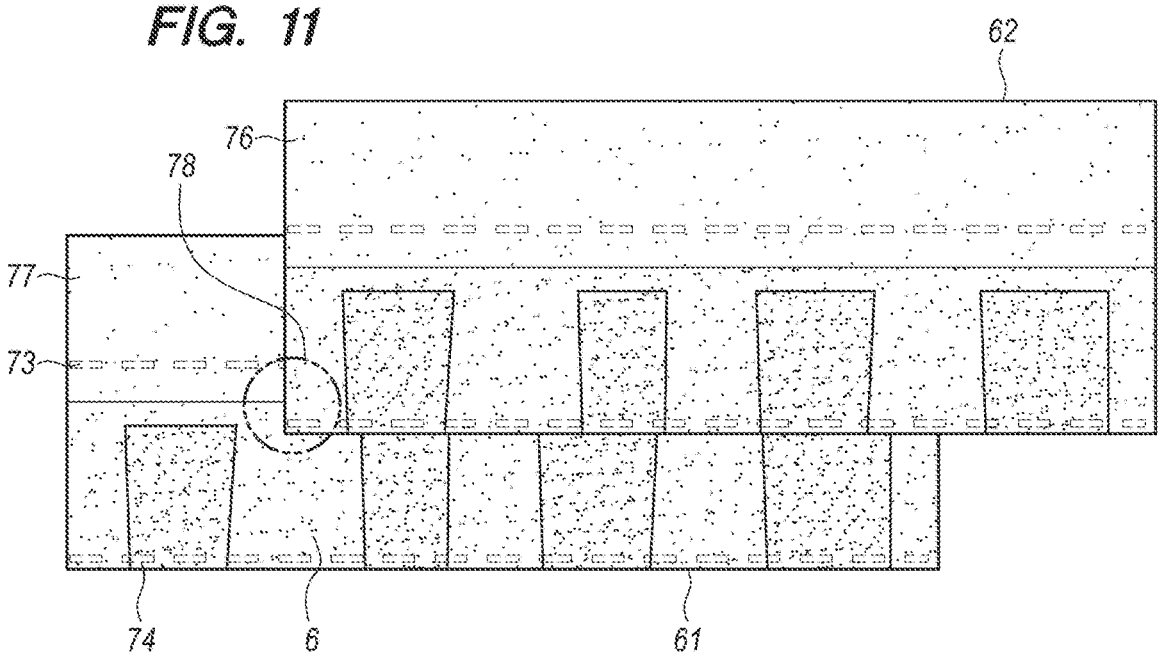
FIG. 11 is a front plan view of a roofing system of two-layer shingles having two sealant lines on the back face of the shingles.
Figure 12:
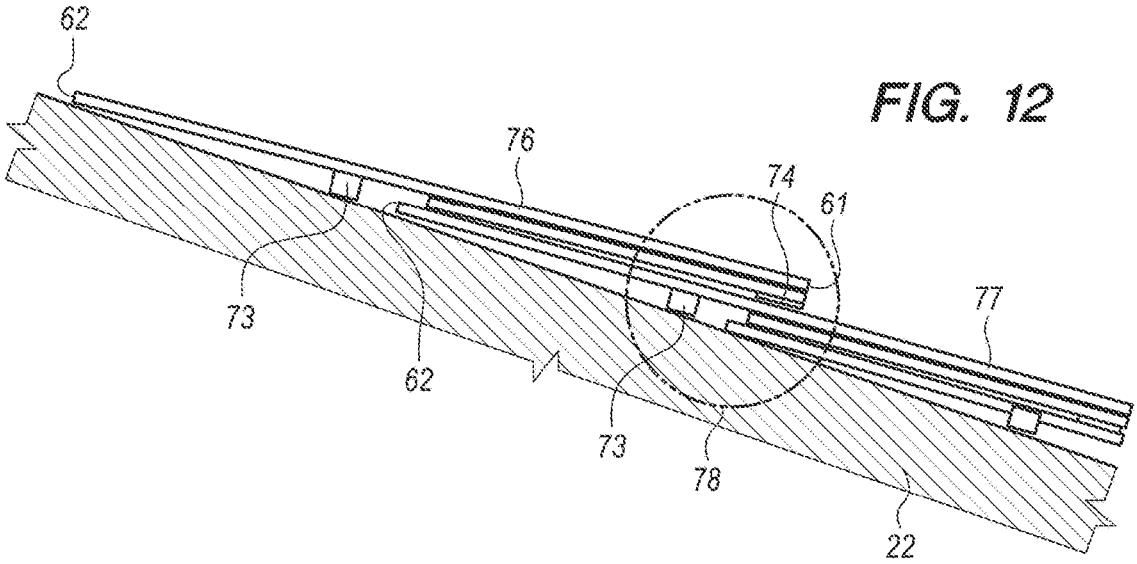
FIG. 12 is a side view of a roofing system of two-layer shingles having two sealant lines on the back face of the shingles.

As shown in FIGS. 11 and 12, when installed on a roof deck in a series of overlapping courses, first sealant line 73 provides adhesion between the back surface 70 of the upper layer 65 of the shingle and the roof deck 22. Second sealant line 74 provides adhesion between the lower edge 67 of the backer 66 strip of a shingle in an upper course 76 and the front surface 69 of the upper layer of a shingle in a lower course 77.

As a result of the relative positioning of the sealant lines, when installed on a roof deck 22 the second sealant line 74 of shingle in an upper course 76 approximately aligns with the first sealant line 73 of a shingle in a lower course 77. This configuration provides a strong load path 78 of the shingles to the roof deck 22 and improves resistance to wind billowing.

Preferably, first sealant line 73 is positioned at a distance that is about the width of the buttlap 64 plus between about 2 inches and about 4 inches from the lower edge 61 of the shingle. In a preferred embodiment, the thickness of the first sealant line 73 is greater than the thickness of the backer strip 66. Preferably, the thickness of the first sealant line 73 is greater than the thickness of the backer strip 66 by at least about 40 mils. When configured in this way the first sealant line 73 may facilitate installation by acting as a shelving guide since when installed the first sealant line 73 of a shingle in an upper course 77 abuts the top edge 62 of a shingle 76 in a lower course.

In an embodiment, the lower edge 11 of the single layer shingle 1, the lower edge 38 of the front layer of two-layer shingle 2 or the lower edge 68 of the front layer of two-layer shingle 6 may be cut to form tabs and openings. The shape of the tabs and openings may be adjusted by varying the angle of cutting and ratio of tab height to tab breadth to give the desired aesthetic appearance. For example, the tabs can be rectangles, dragon teeth or trapezoids.

In a preferred embodiment of single layer shingle 1, the tab height is approximately equal to the width of the buttlap 16 and less than the width of the headlap 17. In a preferred embodiment of the two-layer shingle 2, the tab height is less than the width of the backer strip (wBB). In a preferred embodiment of the two-layer shingle 6, the tab height is less than the width of the backer strip (wCB). The area across the width of two-layer shingle 2 in which the upper layer 35 and the backer strip 36 overlap that is above the tabs of the upper layer 35 is referred to as the common bond area 51. The common bond area 79 of two-layer shingle 6 is the area across the width in which the upper layer 65 and the backer strip 66 overlap that is above the tabs of the upper layer 65.

The exposed top upper surface or weather surface of the invention may be coated with various types of mineral granules to protect the asphalt coating, to add color to shingles 1, 2 and 6 of the invention, and to provide fire resistance. A wide range of mineral colors from white and black to various shades of red, green, brown and any combination thereof may be used on shingles 1, 2 and 6 of the invention to provide a roof having the desired color. In some embodiments, the entire front surface of shingles 1, 2 and 6 of the invention may be coated with any of the aforementioned coatings. In further embodiments of two-layer shingle 2, the entire front surface 39 of the upper layer may be coated with coatings that contrast with coatings applied to the front surface 41 of the backer strip 36. In further embodiments of two-layer shingle 6, the entire front surface 69 of the upper layer may be coated with coatings that contrast with coatings applied to the front surface 71 of the backer strip 66.

In an embodiment, mechanical fasteners may be applied to the shingles in the area of strong load path (such as 23, 50 or 78) where the sealant lines of shingles in adjacent courses are aligned i.e., the traditional nail zone. Preferably the sealant line 14, 45 or 74 is within about 1" of the nail zone or within ½" of the nail zone. This relative positioning of fasteners and sealant lines assists in controlling wind uplift pressure and ensuring that shingles do not bulge when exposed to high winds. In a preferred embodiment, each nail penetrates shingles in 2 different courses, thus increasing the effective number of nails per shingle. For example, in the case of a two-layer shingle, nails may pass through the common bond area of a shingle in an upper course into the headlap of a shingle in a lower course. In another embodiment, the positioning of mechanical fasteners is not restricted to a specific area of the shingles, thereby speeding installation and reducing costs.

In a preferred embodiment, the inventive shingles are applied to the roof deck by typical installation methods, but with reduced quantities of mechanical fasteners, such as 2 or 3 nails per shingle instead of 4 nails per shingle. The appropriate number of nails is found by selecting the minimum quantity that will provide a surface that is sufficiently stable to be walked on by a roofer. Alternatively, the inventive shingles can be applied without the need for mechanical fasteners if the sealant material is capable of activating and providing adequate strength to be walked upon (even on a high pitch roof) shortly after installation. If no mechanical fasteners are applied, the shingle preferably has at least 3 sealant lines.

In an embodiment, the sealant lines are capable of aggressively attaching a shingle to other shingles and to the roof deck upon installation. Preferably, the sealant material has initial tack at low temperatures (so as to provide wind resistance during cold weather applications). In a preferred embodiment, the sealant material has adequate viscosity to resist flow at elevated temperatures (for example, above 100° F.) so as to prevent shingles from sliding off high pitch roofs at elevated temperatures. Suitable sealant materials include bitumen-based sealants, polymer-modified bitumen sealants, butyl adhesives, chloroform adhesives, acrylic adhesives, polyurethane adhesives, epoxies, solvent-based adhesives, emulsion adhesives, cyanoacrylates, and combinations thereof. In a preferred embodiment, the sealant strips are covered with a release tape that is removed prior to installation. In an embodiment, the release tape can be functionalized so that the sealant is activated upon unpacking from the shingle bundle, thus providing rapid curing upon installation. The sealant strips may be continuous, dashed or dotted and may extend across the full length of the shingle, or a part length. Preferably, the sealant strips extend across substantially the entire length of the shingle.

In an embodiment, the shingles are applied directly to the roof deck. The sealant may be selected to give optimal adhesion to the materials of the roof deck (for example, wood roof decks, concrete roof decks, metal roof decks, fiber cement boards, plastic composite boards, or coated surfaces).

In another embodiment, an underlayment is present between the shingles and the roof deck. The underlayment surface may be specifically functionalized to have strong chemical affinity towards the shingle sealant materials that contact it.

Although the present invention and its advantages have been described in detail, it should be understood that various changes, substitutions and alterations can be made therein without departing from the spirit and scope of the invention.

Examples

All sealant lines in the examples have a width of about ⅜" and an average thickness of about 30 mils.

Example 1

Wind Performance Testing

Commercially available GAF Timberline HD laminated shingles (available from GAF, Baltimore, Md.) have a single back sealant line near the lower edge of the bottom layer. Two additional sealant lines of melted asphaltic adhesive Polyco 3120 (available from US Polyco, Ennis, Tex.) were applied to these shingles using templates to form dashed sealant strips. One sealant line was positioned on the back surface of the upper layer about 3 inches from its top edge. Another sealant line was positioned on the back surface of the shingle at the nail zone (i.e., near the top edge of the backer strip). A 50"×60" test deck of these shingles was tested in a wind tunnel for ASTM D3161 Class F (110 mph) wind resistance. The shingles were applied to the roof deck at 2/12 slope without any nails or fasteners.

In Test Deck #1, the underlying plywood roof deck was covered by an underlayment of 15 #roofing felt that was attached to roof deck using tin cap nails. In Test Deck #2, the plywood roof deck was covered by a peel and stick-type underlayment (StormGuard available from GAF, Parsippany, N.J.). After preparation of the roof deck and shingle installation (without any nails), both decks were conditioned at a chamber set at 140° F. for 16 hours. After conditioning, both decks were cooled to room temperatures and then tested in a wind tunnel. Both test decks were found to pass the ASTM D3161 fan induced wind test with no sign of any shingle lifting or any shingle detachment from the roof deck.

Figure 18:
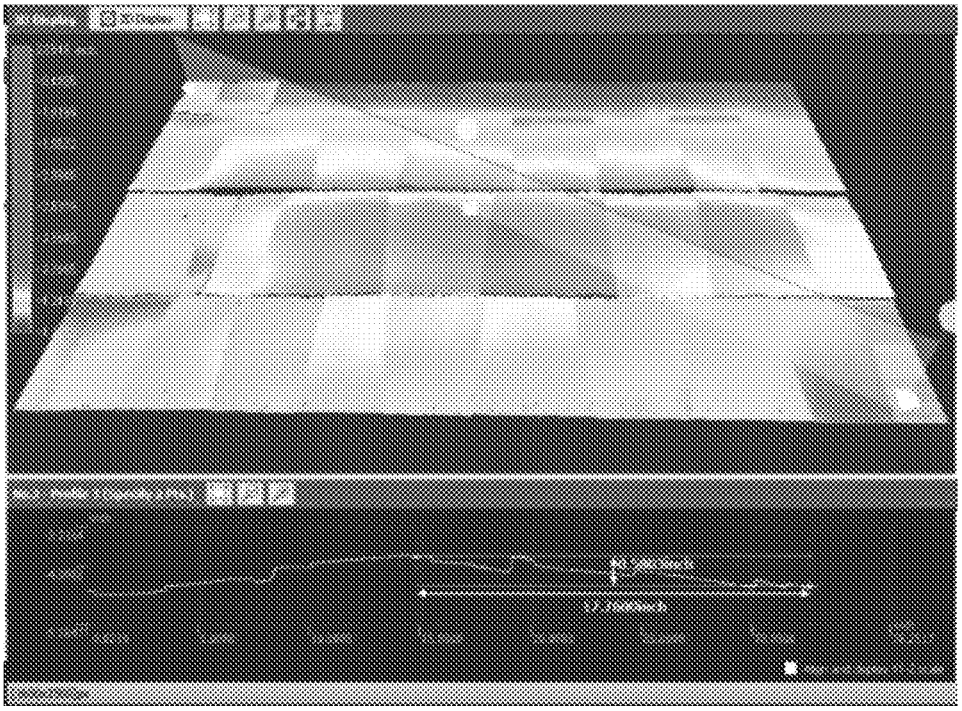
FIG. 18 shows 3D scanning data for a roof deck as described in Example 1 during the ASTM D3161 wind test at 110 mph.

The wind uplift profile of Test Deck #1 during the ASTM D3161 test was also measured with a 3D laser scan (see below for methodology). The 3D uplift profile for Test Deck #1 is illustrated in FIG. 18 that also shows the profile data along the diagonal line that produced an uplift of 0.58". Test Deck #1 passed the ASTM D3161 test at 110 mph for 2 hours. This performance is comparable to that provided by Timberline shingles installed with the conventional 4 nails (these provided a measured uplift of 0.488" with the 3D laser scan in the ASTM D3161 test at 110 mph).

The experiment was repeated with 2 nails applied per shingle at the shingle butt edges. This test deck passed the ASTM D3161 test at 150 mph for 2 hours (with some bulging).

Comparative Example 1A

Commercially available GAF Timberline HD laminated shingles with no additional adhesive lines were installed on a roof deck as in Test Deck #1 (above) (i.e., with no fasteners). Wind tunnel testing at 110 mph produced significant bulging of the shingles. At approximately 34 minutes the shingles failed the test. This comparative example shows that traditional shingles do not pass the ASTM D3161 test if no fasteners are used.

Figure 19:
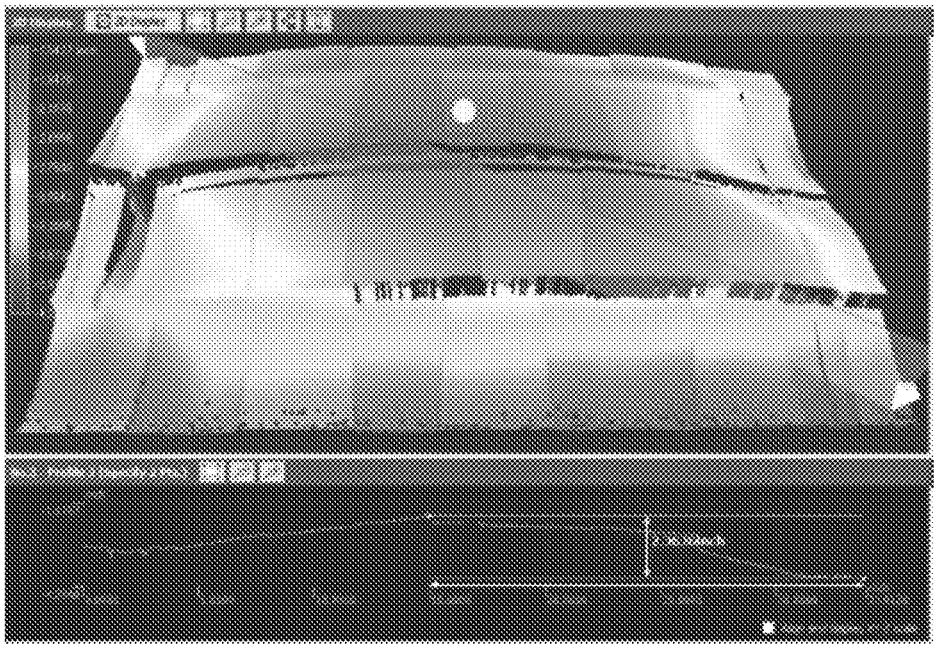
FIG. 19 shows 3D scanning data for a roof deck as described in Comparative Example 1A during the ASTM D3161 wind test at 110 mph.

The wind uplift profile of the test deck of Comparative Example 1A during the ASTM D3161 test was also measured with the 3D laser scan methodology. The 3D uplift profile for the test deck of Comparative Example 1A is illustrated in FIG. 19. The test deck of Comparative Example 1A gave a maximum wind uplift of 2.36". The shingles showed noticeable bulging or bowing and the shingle deformation resulted in more air penetration through the course of shingles, thereby causing the shingles ultimately to fail the ASTM D3161 test.

Comparative Example 1B

Comparative Example 1 was repeated, except that a single additional sealant line of Polyco 3120 was applied to the back of the shingles about 4" from the top of the headlap. Wind tunnel testing at 110 mph produced bulging of the shingles, however, this did not fully occur until about 15 minutes into the test. The test deck failed after 20 minutes. This comparative example shows that the addition of an extra sealant line in this position improves adhesion of the shingles to the roof deck, but is insufficient to fully transfer the wind uplift force to the roof deck, meaning that these shingles also cannot pass the ASTM D3161 test if no fasteners are used.

Figure 20:
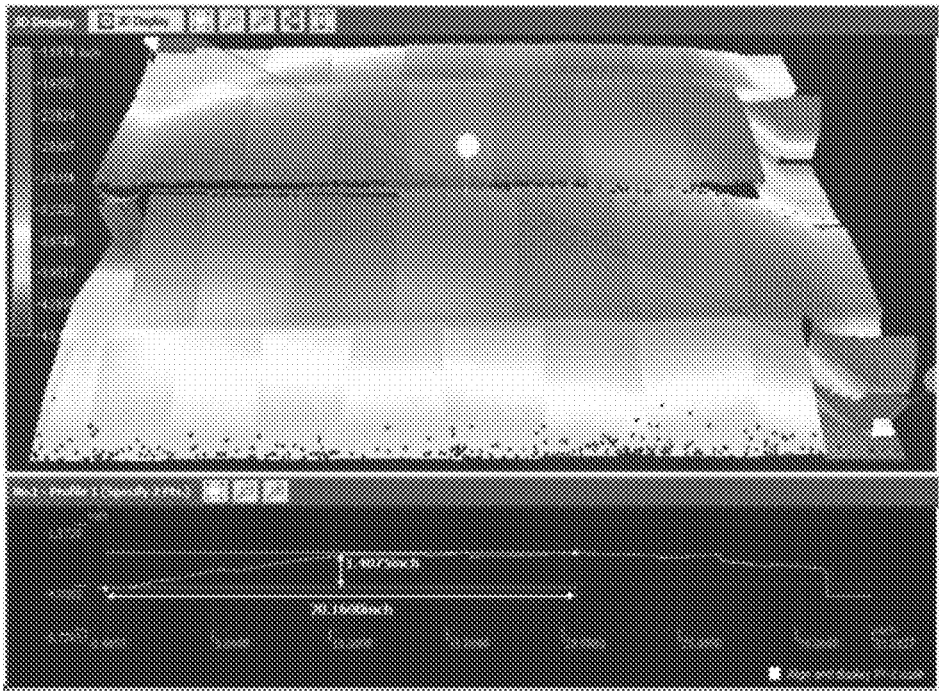
FIG. 20 shows 3D scanning data for a roof deck as described in Comparative Example 1B during the ASTM D3161 wind test at 110 mph.

The wind uplift profile of the test deck of Comparative Example 1B during the ASTM D3161 test was also measured with the 3D laser scan methodology. The 3D uplift profile for the test deck of Comparative Example 1B is illustrated in FIG. 20. The test deck of Comparative Example 1B gave a maximum wind uplift of 1.41". The shingles showed less noticeable bulging or bowing than those in Comparative Example 1A. But the shingle deformation resulted in air penetration through the course of shingles, which increases the potential for wind failure.

3D Laser Scanner Uplift Test

The shingle deformation or shingle uplift during a wind tunnel test was measured by determining the shingle movement using a 3D profile scanner installed over the shingle test deck inside the wind tunnel. The 3D profile canner can determine the shingle movement in the direction vertical to the wind direction, thereby measuring the degree of wind-induced uplift as a function of the wind speed or wind duration.

To collect the data, the ASTM D3161 test method for testing the shingle wind performance using fan-induced wind was followed. To measure the shingle profile during the wind test, a 3D profile scanner was mounted to a rigid metal frame that was firmly attached to the test rack. The 3D scanner was installed perpendicular to the roof deck and the wind direction. The 3D scanner used was the LJ-V7000 laser scanning system from Keyence (Keyence Corporation of America, Elmwood Park, N.J.) with a scanning range of 20" and accuracy of ±0.001". The area of interest for the ASTM D3161 shingle wind testing were the shingle courses starting at the 3rd course and above, based upon the shingle exposure. The 3D profile of the 3rd, 4th, and partially 5th shingle courses were observed. The measure of shingle uplift induced by the wind was then based upon the vertical distance from the highest point of the measured area to the base line of the shingle surface that received no direct wind hit. This was calculated by taking the maximum shingle surface point in the measuring area and subtracting the elevation of the shingle surface point in the 2nd course where it received little direct wind hit.

Example 2

Laminated shingles (Timberline HD shingle from GAF in Tuscaloosa, Ala.) were mechanically indented to test the effect of mechanical indentation upon slump resistance performance. The shingles were mechanically indented along the center line of the laminating adhesive in the common bond area, see FIGS. 13 & 14. The indentation was made by using a punch wheel and tractor roll as illustrated in FIGS. 15 & 16, wherein the punch wheel and tractor roll were synchronized in speed with the movement of the shingle web during shingle making. The mechanical indentation was done immediately after the top layer (or "dragon tooth" layer) was combined with the bottom (or "backer") layer. The indentation used has the geometry shown in FIG. 16. The depth of the indentation was targeted at 0.156", which is 84% of the average thickness of the common bond area. The resulting shingles had a uniform line of mechanical indentation along the center line of the common bond area, and the resultant shingles showed an averaged slump temperature of 185±2.95° F. and 190±0.0° F. according to the slump test (see, below), which is significantly higher than the slump temperature of 172.2±5.14° F. for the same shingles without indentation. This demonstrates that mechanical indentation can significantly improve the slump resistance performance of a laminated shingle.

However, these indented shingles were found to exhibit increased cracking associated with the indentation location after a standardized shingle bundle handling test at 120° F. All 11 tested shingles showed surface cracking, and 4 of these were cracked through.

Shingle Slump Temperature Test

Sampling

1. Collect one shingle from each lane from one pallet.
2. Do not test the shingles sooner than 24 hours after manufacture.
3. Condition the shingles at ambient temperature at least 2 hours before testing.

Sample Preparation

1. Cut 3, 4" MD×8" CD samples from the shingle from each lane. The sample should be taken from the shim and must include the full face exposure and the common bond.

Test Procedure

1. Set the oven at 130±5° F.
2. Place the metal clips on the headlap portion of the sample.
3. Hang the sample vertically from the clips, shim down, in the oven.
4. After one hour, inspect the sample.
5. If the shim has not dropped from the headlap, increase the oven temperature 10° F.
6. Repeat steps 2 through 5 until the shim drops from the headlap or a test temperature of 180° F. is reached, and then proceed to the next step.
7. Record the laminate slump temperature
8. Repeat steps 1 through 7 for the other lanes.

Example 3

The laminate shingles in Example 2 were mechanically indented with a number of different punch geometries and with varying indentation depths and/or spacing to study the impact of these parameters on cracking induced by the standardized shingle bundle handling test. The results are shown in Table 1. The data in Table 1 demonstrate that the punch geometry with medium radius punch head, 65% or less punch depth, and larger spacing at 2" has the lowest potential for cracking during shingle handling by a roofer. The data further show that the rounded rectangular and small dome (hemisphere) punch geometries produce the least cracking during handling.

TABLE 1

| | | | | | Indentation Variables | | Outcomes (# of cracks) | |
|---|---|---|---|---|---|---|---|---|
| | | Indentation Geometry | | | | | surface | crack |
| Indentation Type | Shape Description | Radius, inch | Width, inch | Length, inch | punch depth, in | punch spacing, in | crack in the back | through to the top |
| A | rounded rectangular | 0.128 | 0.25 | 0.1 | 0.156 | 1 | 3 | 3 |
| A | rounded rectangular | 0.128 | 0.25 | 0.1 | 0.156 | 2 | 1 | 4 |
| B | rounded rectangular | 0.125 | 0.25 | 0.1 | 0.125 | 1 | 3 | 5 |
| B | rounded rectangular | 0.125 | 0.25 | 0.1 | 0.125 | 2 | 3 | 2 |
| C | Rounded Pin | 0.091 | 0.125 | 0.125 | 0.156 | 0.5 | 5 | 6 |
| D | Rounded Pin | 0.078 | 0.125 | 0.125 | 0.125 | 0.5 | 7 | 6 |
| E | Large dome | 0.191 | 0.375 | — | 0.156 | 1 | shingle failed | shingle failed |
| E | Large dome | 0.191 | 0.375 | — | 0.156 | 2 | shingle failed | shingle failed |
| F | Large dome | 0.203 | 0.375 | — | 0.125 | 1 | shingle failed | shingle failed |
| G | half moon | 0.106 | 0.187 | 0.1 | 0.156 | 1 | 5 | 4 |
| H | half moon | 0.097 | 0.187 | 0.1 | 0.125 | 1 | 3 | 3 |
| H | half moon | 0.097 | 0.187 | 0.1 | 0.125 | 0.5 | 3 | 6 |
| I | large rivet | 0.625 | 0.75 | 0.1 | 0.125 | 1 | 2 | 4 |
| I | large rivet | 0.625 | 0.75 | 0.1 | 0.125 | 2 | 4 | 4 |
| J | large rivet | 0.529 | 0.75 | 0.1 | 0.156 | 2 | 3 | 4 |
| K | small rivet | 0.203 | 0.375 | 0.1 | 0.125 | 1 | 3 | 4 |
| K | small rivet | 0.203 | 0.375 | 0.1 | 0.125 | 2 | 2 | 2 |
| L | small rivet | 0.191 | 0.375 | 0.1 | 0.156 | 2 | 4 | 4 |
| A | rounded rectangular | 0.128 | 0.25 | 0.1 | 0.156 | 1" offset double line | 7 | 4 |
| M | small dome | 0.125 | 0.25 | — | 0.125 | 2 | 1 | 0 |
| N | round bar | 0.0625 | 0.125 | — | 0.125 | continuous | 0 | 0 |

The invention claimed is:

1. A roofing system, comprising:

a roof deck; and a roofing shingle installed above the roof deck, wherein the roofing shingle comprises:

a first shingle layer;

a second shingle layer, wherein the first shingle layer and the second shingle layer overlap to form a common bond area;

a first attachment between the first shingle layer and the second shingle layer, wherein the first attachment is in the common bond area, wherein the first attachment comprises a first indentation in the first shingle layer, wherein the first indentation comprises a dome shape, wherein a depth of the first indentation is at most 90% of a thickness of the common bond area, wherein a radius of the first indentation is about ⅛ inch, wherein a width of the first indentation is about ¼ inch; and a second attachment between the first shingle layer and the second shingle layer, wherein the second attachment is in the common bond area, wherein the second attachment comprises a second indentation in the first shingle layer.

2. The roofing system of claim 1, further comprising:

an underlayment, wherein the underlayment is between the roof deck and the roofing shingle.

3. The roofing system of claim 1, wherein the roofing shingle further comprises:

an adhesive in the common bond area, between the first shingle layer and the second shingle layer.

4. The roofing system of claim 1, wherein the depth of the first indentation is less than 65% of the thickness of the common bond area.

5. The roofing system of claim 1, wherein the depth of the first indentation is less than 50% of the thickness of the common bond area.

6. The roofing system of claim 1, wherein the depth of the first indentation is from 50% to 90% of the thickness of the common bond area.

7. The roofing system of claim 1, wherein a spacing between the first indentation and the second indentation is about 2 inches.

8. The roofing system of claim 1, wherein a spacing between the first indentation and the second indentation is about 0.5 inches to about 2 inches.

9. A roofing system, comprising:

a roof deck; and a roofing shingle installed above the roof deck, wherein the roofing shingle comprises:

a first shingle layer;

a second shingle layer, wherein the first shingle layer and the second shingle layer overlap to form a common bond area;

a first attachment between the first shingle layer and the second shingle layer, wherein the first attachment is in the common bond area, wherein the first attachment comprises a first indentation in the first shingle layer, wherein the first indentation comprises a rounded rectangular shape, wherein a depth of the first indentation is at most 90% of a thickness of the common bond area, wherein a radius of the first indentation is about ⅛ inch, wherein a width of the first indentation is about ¼ inch; and a second attachment between the first shingle layer and the second shingle layer, wherein the second attachment is in the common bond area, wherein the second attachment comprises a second indentation in the first shingle layer.

10. The roofing system of claim 9, further comprising:

an underlayment, wherein the underlayment is between the roof deck and the roofing shingle.

11. The roofing system of claim 9, wherein the roofing shingle further comprises:

an adhesive in the common bond area, between the first shingle layer and the second shingle layer.

12. The roofing system of claim 9, wherein the depth of the first indentation is less than 65% of the thickness of the common bond area.

13. The roofing system of claim 9, wherein the depth of the first indentation is less than 50% of the thickness of the common bond area.

14. The roofing system of claim 9, wherein the depth of the first indentation is from 50% to 90% of the thickness of the common bond area.

15. The roofing system of claim 9, wherein a spacing between the first indentation and the second indentation is about 2 inches.

16. The roofing system of claim 9, wherein a spacing between the first indentation and the second indentation is about 0.5 inches to about 2 inches.

17. A roofing system, comprising:

a roof deck; and a roofing shingle installed above the roof deck, wherein the roofing shingle comprises:

a first shingle layer;

a second shingle layer, wherein the first shingle layer and the second shingle layer overlap to form a common bond area;

a first attachment between the first shingle layer and the second shingle layer, wherein the first attachment is in the common bond area, wherein the first attachment comprises a first indentation in the first shingle layer, wherein the first indentation comprises a rivet shape, wherein a depth of the first indentation is at most 90% of a thickness of the common bond area, wherein a radius of the first indentation is about 3/16 inch to about ⅝ inch, wherein a width of the first indentation is about ⅜ inch to about ¾ inch; and a second attachment between the first shingle layer and the second shingle layer, wherein the second attachment is in the common bond area, wherein the second attachment comprises a second indentation in the first shingle layer.

18. The roofing system of claim 17, further comprising:

an underlayment, wherein the underlayment is between the roof deck and the roofing shingle.

19. The roofing system of claim 17, wherein the roofing shingle further comprises:

an adhesive in the common bond area, between the first shingle layer and the second shingle layer.

20. The roofing system of claim 17, wherein the depth of the first indentation is less than 65% of the thickness of the common bond area.

21. The roofing system of claim 17, wherein the depth of the first indentation is less than 50% of the thickness of the common bond area.

22. The roofing system of claim 17, wherein the depth of the first indentation is from 50% to 90% of the thickness of the common bond area.

23. The roofing system of claim 17, wherein a spacing between the first indentation and the second indentation is about 2 inches.

24. The roofing system of claim 17, wherein a spacing between the first indentation and the second indentation is about 0.5 inches to about 2 inches.

25. A roofing system, comprising:

a roof deck; and a roofing shingle installed above the roof deck, wherein the roofing shingle comprises:

a first shingle layer;

a second shingle layer, wherein the first shingle layer and the second shingle layer overlap to form a common bond area;

an attachment between the first shingle layer and the second shingle layer, wherein the attachment is in the common bond area, wherein the attachment comprises a indentation in the first shingle layer, wherein the indentation comprises a round bar shape, wherein a depth of the indentation is at most 90% of a thickness of the common bond area, wherein a radius of the indentation is about 1/16 inch, wherein a width of the indentation is about ¼ inch.

26. The roofing system of claim 25, further comprising:

an underlayment, wherein the underlayment is between the roof deck and the roofing shingle.

27. The roofing system of claim 25, wherein the roofing shingle further comprises:

an adhesive in the common bond area, between the first shingle layer and the second shingle layer.

28. The roofing system of claim 25, wherein the depth of the indentation is less than 65% of the thickness of the common bond area.

29. The roofing system of claim 25, wherein the depth of the indentation is from 50% to 90% of the thickness of the common bond area.

30. The roofing system of claim 25, wherein the indentation extends from one end of the roofing shingle to another end of the roofing shingle.

* * * * *